US011259583B1

(12) United States Patent
Spanopoulos

(10) Patent No.: US 11,259,583 B1
(45) Date of Patent: Mar. 1, 2022

(54) APPAREL FOR SECURING AND CARRYING AN OBJECT

(71) Applicant: Arrowhead Tactical Apparel, LLC, Brentwood, TN (US)

(72) Inventor: Alexander Wray Spanopoulos, Germantown, TN (US)

(73) Assignee: ARROWHEAD TACTICAL APPAREL, LLC, Brentwood, TN (US)

( * ) Notice: Subject to any disclaimer, the term of this patent is extended or adjusted under 35 U.S.C. 154(b) by 0 days.

(21) Appl. No.: 17/412,986

(22) Filed: Aug. 26, 2021

Related U.S. Application Data

(60) Provisional application No. 63/071,171, filed on Aug. 27, 2020.

(51) Int. Cl.
*A41F 9/02* (2006.01)
*F41C 33/04* (2006.01)
*F41C 33/02* (2006.01)

(52) U.S. Cl.
CPC ..... *A41F 9/025* (2013.01); *F41C 33/0236* (2013.01); *F41C 33/041* (2013.01); *F41C 33/048* (2013.01)

(58) Field of Classification Search
CPC ..... F41C 33/046; F41C 33/041; F41C 33/02; F41C 33/048; F41C 33/0236; A41F 9/02; A41F 9/00; A41F 9/025; A41F 9/007
See application file for complete search history.

(56) References Cited

U.S. PATENT DOCUMENTS 1,506,255 A * 8/1924 Rosenstein ..... A41F 9/025 2/236
1,584,765 A * 5/1926 Gillette ..... A41F 9/00 2/236
1,930,049 A * 10/1933 Heller ..... A41F 9/02 2/236
2,349,019 A * 5/1944 Terrell ..... A41F 9/025 2/221
10,455,877 B2 * 10/2019 Moore ..... A41F 9/02
2007/0136930 A1 * 6/2007 Dipietro ..... A41D 1/06 2/227
2010/0313336 A1 * 12/2010 Carlson ..... A41F 9/007 2/215
2014/0096304 A1 * 4/2014 Martinez ..... A41D 1/00 2/79
2016/0100642 A1 * 4/2016 Swan ..... A41F 9/007 2/236
2016/0262478 A1 * 9/2016 Moore ..... A41F 9/00
2020/0370864 A1 * 11/2020 Cochran ..... F41C 33/048

* cited by examiner

*Primary Examiner* — Corey N Skurdal
(74) *Attorney, Agent, or Firm* — Bass, Berry & Sims, PLC; Shu Chen

(57) ABSTRACT

An article of clothing comprises a waistband configured to secure and carry at least one object on a wearer's waist. The waistband includes a first portion configured to form a circumferential waist part of the article of clothing and include at least a first channel and a second channel, the first channel having an elastic band therethrough, and the second channel having drawstrings therethrough. The waistband also includes a second portion configured to include a plurality of belt loops evenly spaced and positioned along the first portion of the waistband, wherein the plurality of belt loops are configured to receive a belt assembly therethrough.

20 Claims, 11 Drawing Sheets

APPAREL FOR SECURING AND CARRYING AN OBJECT

CROSS REFERENCE TO RELATED APPLICATION

The application claims priority to U.S. Provisional Patent Application No. 63/071,171 filed on Aug. 27, 2020, entitled "APPAREL FOR SECURING AND CARRYING AN OBJECT," the content of which is incorporated by reference herein in its entirety.

FIELD OF TECHNOLOGY

The present disclosure generally relates to securing and carrying an object, and more particularly relates to an apparel designed to provide a concealed carry of an object (e.g., a handgun) around a waist of a wearer.

BACKGROUND

For every day carry (EDC) of a gun, many individuals with concealed carry licenses may choose not to wear athletic/fitness apparel and/or light weight clothing typically worn for the purpose of comfort, flexibility, or athletic activities (e.g., sweatpants, joggers, or shorts) because these clothing are not conducive to safe concealed carry of handguns or other EDC essentials and objects. Traditional means of securing waist-mounted EDC objects (e.g., a concealed handgun) include outside the waistband (OWB) or belt holsters, which are most commonly used by police and military, and by citizens who choose to carry a handgun openly or concealed. Belt holsters may be worn high and close to the body, slightly behind the hip bone (e.g., 4 o'clock position), and may be concealed under a long, untucked shirt or jacket. Belt holsters are commonly worn with belted pants such as blue jeans, khakis, or cargo pants made from durable materials. However, should an individual desire to wear apparel that is suitable for running, jogging or performing strenuous activities, it is challenging for one to conceal carry safely and securely. Attempting to wear a gun belt, holster, fanny pack, girdle of elastic, or backpack currently available on the market may allow the holster or pack to become highly mobile during movement and swing back and forth or move rapidly up and down causing discomfort for the wearer, often allowing the handgun to disengage from the holster or for the holster and gun to fully detach from the body. Furthermore, attempting to carry concealed while wearing athletic/fitness apparel and/or light weight clothing may cause the holstered handgun to sag on a wearer's waist, putting the gun in a poor position that increases the likelihood of unintentionally separating the handgun from the wearer and also increasing the wearer's fatigue and discomfort. Lastly, if the wearer attempts to draw the weapon quickly when attempting to carry concealed while wearing athletic/fitness apparel and/or light weight clothing, it is likely that the holster will remain attached to the handgun during the draw, rendering the handgun inoperable until further action is taken by the wearer to manually separate the handgun from the holster.

Accordingly, there is a need for a tactical apparel designed to provide a concealed carry of an object (e.g., a handgun) around a waist of a wearer having an active lifestyle.

SUMMARY

The present disclosure provides an article of clothing comprising: a waistband configured to secure and carry at least one object on a wearer's waist. The waistband may comprise a first portion configured to form a circumferential waist part of the article of clothing and include at least a first channel and a second channel, the first channel having an elastic band therethrough, and the second channel having drawstrings therethrough; and a second portion configured to include a plurality of belt loops evenly spaced and positioned along the first portion of the waistband, wherein the plurality of belt loops are configured to receive a belt assembly therethrough.

In one embodiment, the at least one object may include a holster with a handgun stored therein, wherein the holster comprises at least one releasable holster clip for releasably securing the holster to the waistband. The belt assembly has a horizontal stretch and a vertical rigidity. The elastic band may be configured to have a first horizontal stretch factor selected to accommodate a range of waist sizes of wearers. The belt assembly may be configured to have a second horizontal stretch factor selected to provide a support for waist-mounted accessories and a consistently firm foundation on the waistband, wherein the second horizontal stretch factor is less than the first horizontal stretch factor. The drawstrings may be configured to have a third horizontal stretch factor selected to provide a snug and secure fit of the waistband on a wearer's body, wherein the third horizontal stretch factor is less than the second horizontal stretch factor.

In one embodiment, the belt assembly may comprise two fastening members configured to form an in-line buckle at the front of the waistband via a pair of permanent magnets. The belt assembly may comprise a strap configured to at least releasably attach to at least one of the two fastening members.

In yet another embodiment, the first portion of the waistband may be configured to face an outside of the article of clothing. The second portion of the waistband may be configured to face an outside of the article of clothing.

In certain embodiments, the at least one releasable holster clip may be affixed onto the first portion of the waistband. Further, the at least one releasable holster clip may be affixed onto the belt assembly of the waistband.

In another embodiment, the article of clothing may further comprise at least one pocket for storing one or more objects, wherein the waistband is configured to support a weight of the one or more objects via the elastic band, drawstrings and the belt assembly.

In one preferred embodiment, the plurality of belt loops of the waistband may be configured to be placed approximately at a wearer's 1 o'clock, 3 o'clock, 5 o'clock, 7 o'clock, 9 o'clock, and 11 o'clock positions. A first spacing between two adjacent belt loops at the wearer's 1 o'clock and 11 o'clock positions may be greater than a second spacing between two adjacent belt loops in other positions, wherein the first spacing is approximately 2-5 times greater than the second spacing. The plurality of belt loops may be of uniform sizes or different sizes.

In yet another embodiment, the belt assembly may comprise a detachable buckle, a belt and a tension lock. The detachable buckle may include two vertical legs, wherein an obstruction is implemented on a base of each vertical leg to retain the belt around the wearer's waist via a respective cylindrical loop at two distal ends of the belt. The belt may be configured to have a horizontal stretch factor greater than its vertical stretch factor.

The above simplified summary of example aspects serves to provide a basic understanding of the present disclosure. This summary is not an extensive overview of all contemplated aspects, and is intended to neither identify key or critical elements of all aspects nor delineate the scope of any or all aspects of the present disclosure. Its sole purpose is to present one or more aspects in a simplified form as a prelude to the more detailed description of the disclosure that follows. To the accomplishment of the foregoing, the one or more aspects of the present disclosure include the features described and exemplary pointed out in the claims.

BRIEF DESCRIPTION OF THE DRAWINGS

The accompanying drawings, which are incorporated into and constitute a part of this specification, illustrate one or more example aspects of the present disclosure and, together with the detailed description, serve to explain their principles and implementations.

DETAILED DESCRIPTION

Figures 1A, 1B, 1C, 1D, 1E:
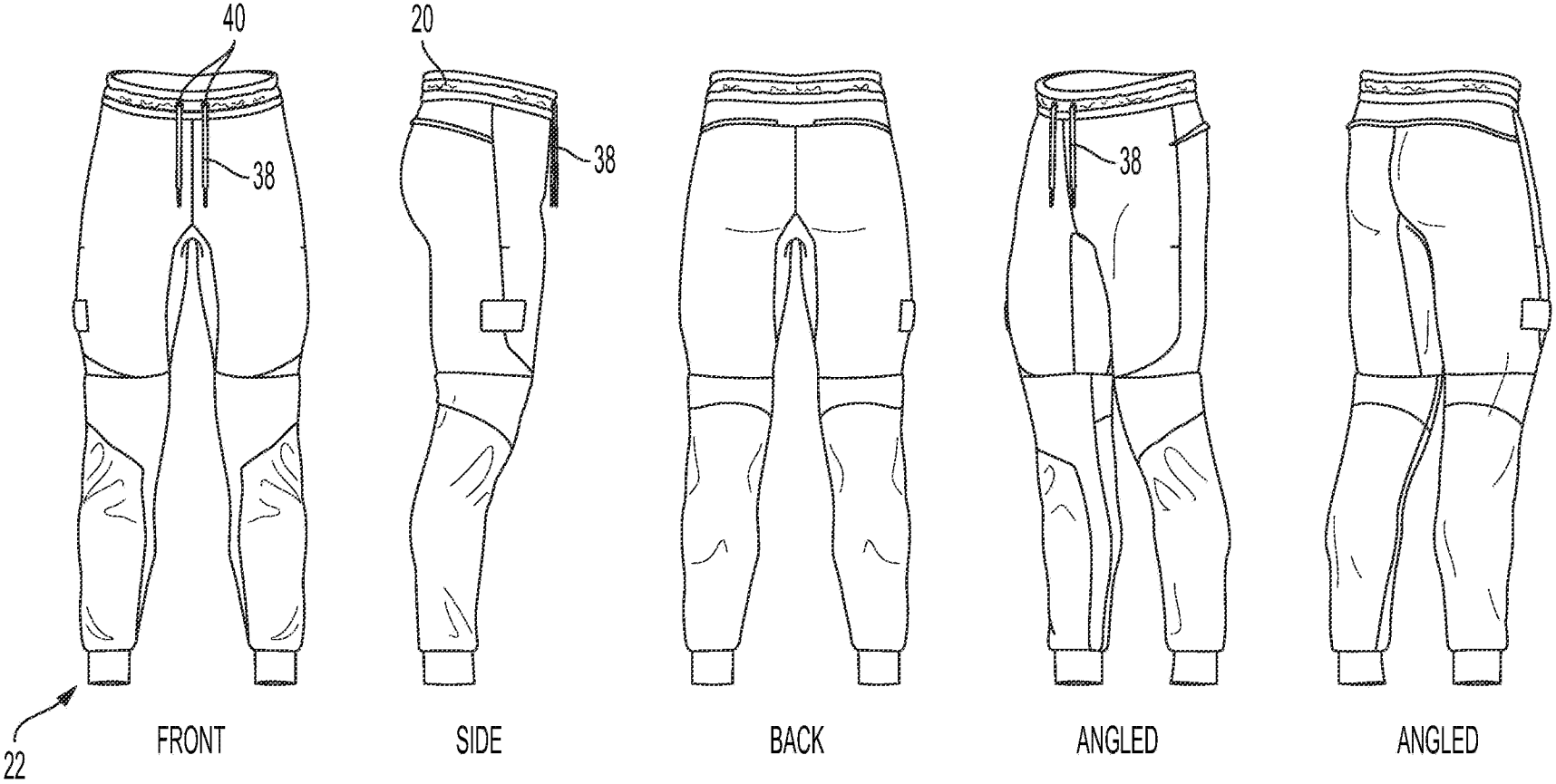
FIGS. 1A, 1B, 1C, 1D and 1E illustrate a number of different views (e.g., a front view, a side view, a back view and angled views) of an example pair of jogger pants designed to include a waistband and other features for optimizing a wearer's EDC of an object including at least one holstered handgun and other objects the wearer needs to feel comfortably prepared, according to an exemplary aspect of the present disclosure.

Various aspects of invention will be described with reference to the drawings, wherein like reference numerals are used to refer to like elements throughout. In the following description, for purposes of explanation, numerous specific details are set forth in order to promote a thorough understanding of one or more aspects of the invention. It may be evident in some or all instances, however, that any aspects described below can be practiced without adopting the specific design details described below.

FIGS. 1A, 1B, 1C, 1D, 1E, 2, 3, 4 and 5 illustrate tactical clothing or apparel that may be configured to include a waistband portion 20 for securing and carrying an object (e.g., a handgun in a holster, a weapons light, flashlight, laser device, telescopic sight, knife, multi-tool, pepper spray can, collapsible baton etc.), according to embodiments of the present disclosure. Waistband portion 20 may be implemented on any suitable lower body apparel such as trousers, pants, khakis, chinos, leggings, or jeans. In some preferred embodiments as shown in FIGS. 1A, 1B, 1C, 1D, 1E, 2, 4 and 5, example apparel may include athletic/fitness apparel or light weight clothing typically worn for comfort or for strenuous activities such as running pants, joggers (FIGS. 1A, 1B, 1C, 1D, 1E, 2 and 5), ski pants, training pants, track pants, sweatpants, basketball pants, running capris, yoga pants, shorts (FIG. 4), board shorts, swim trunks, skorts, or an athletic skirt. Such apparel may advantageously allow a wearer to manage and distribute weight of objects carried on waistband portion 20 or other portions of the apparel while moving around or engaging in activities such as running and exercising.

Figure 2:
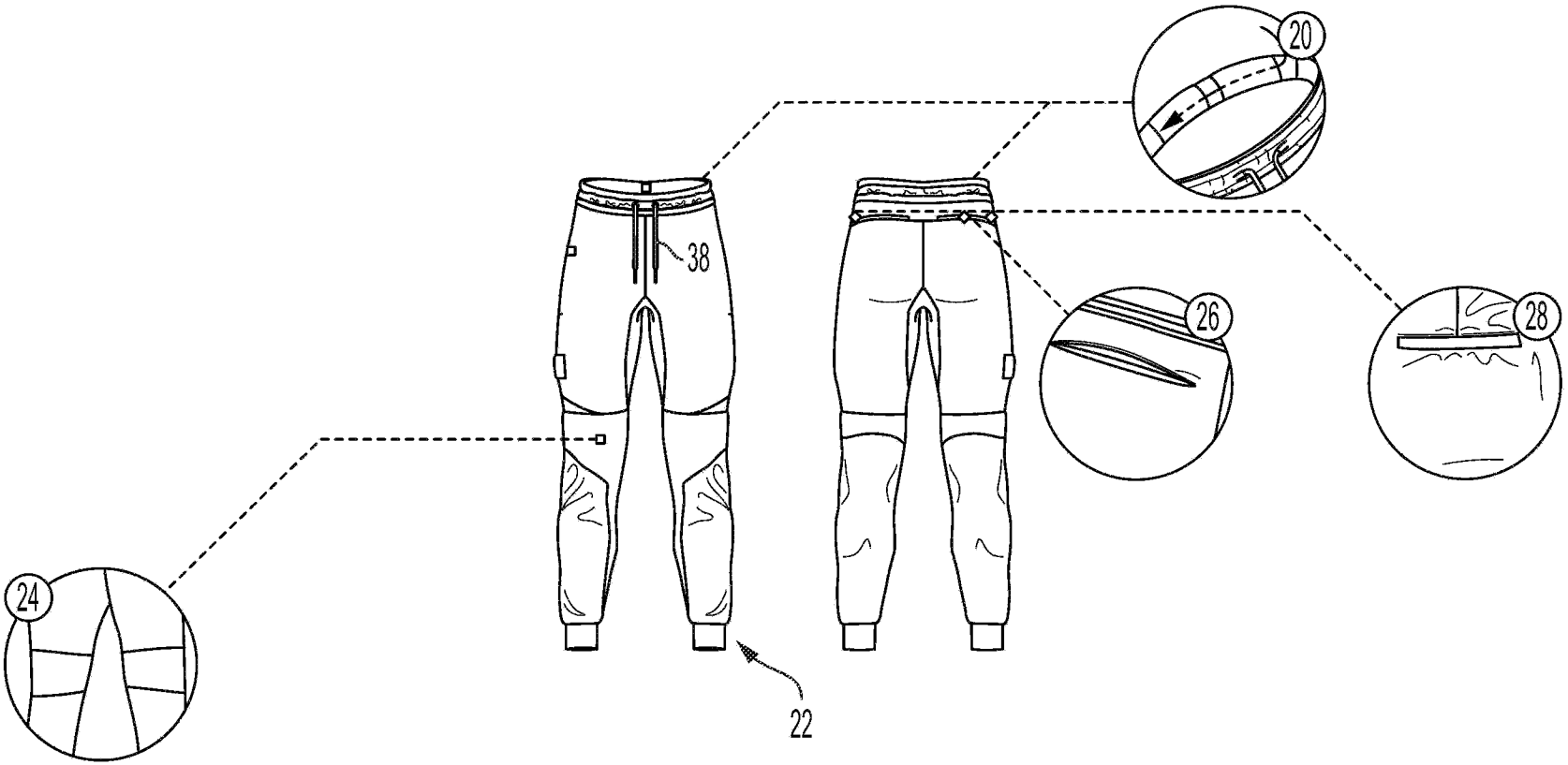
FIG. 2 illustrates an example pair of jogger pants having a number of features and designed to include a waistband and other features for optimizing a wearer's EDC of an object including at least one holstered handgun and other objects the wearer needs to feel comfortably prepared, according to an exemplary aspect of the present disclosure.

Referring to FIGS. 1A and 2, an example pair of jogger pants or joggers 22 may be designed to include waistband 20 and other features for optimizing a wearer's EDC including at least one holstered handgun and other objects. Specifically, joggers 22 may have an athletic design with a tapered fit and waistband 20 may be selectively adjusted by the wearer for various activities, needs, or personal preferences. In one embodiment, joggers 22 may be made of breathable cotton or polyester blended fabric with durable knee paneling 24. It should be appreciated that fabrics that have different weight may be used for different applications or portions of joggers 22. For example, a heavier weight material may be used for cold weather sports (e.g., ski pants), and a lighter weight fabric may be used in a garment designed for warmer weather use. In addition, joggers 22 may be configured to have elastic modulus values that may vary depending upon the functions of different portions of joggers 22. In one embodiment, stiffer and high powered material (i.e., high elastic modulus) may be introduced through knit intarsia or cut-and-sew construction techniques. In another embodiment, a 3-dimensional knitting process may be used for making joggers 22. This process may achieve minimal seams, finishing, and edge stitching, thereby improving the comfort and wearability of joggers 22.

Among other features, as shown in FIG. 2, joggers 22 may be designed to provide zippered rear concealed pockets 26 with inner elasticated pockets (e.g., used as internal handgun magazine pouches) and concealed hip-mounted utility pockets 28 for small tools or other objects. The waistband portion 20 may be required to support the additional weight from two handgun magazines in the pockets and two small tools in the hip utility pockets (e.g., two Glock 17 magazines with 34 combined rounds of 9 mm ammunition, totaling 20.5 ounces, and two Columbia River Knife and Tool M16-14ZLEK folding utility knives, totaling 12.4 ounces) to prevent the apparel from sagging and to prevent the items from bouncing when secured.

Figure 3:
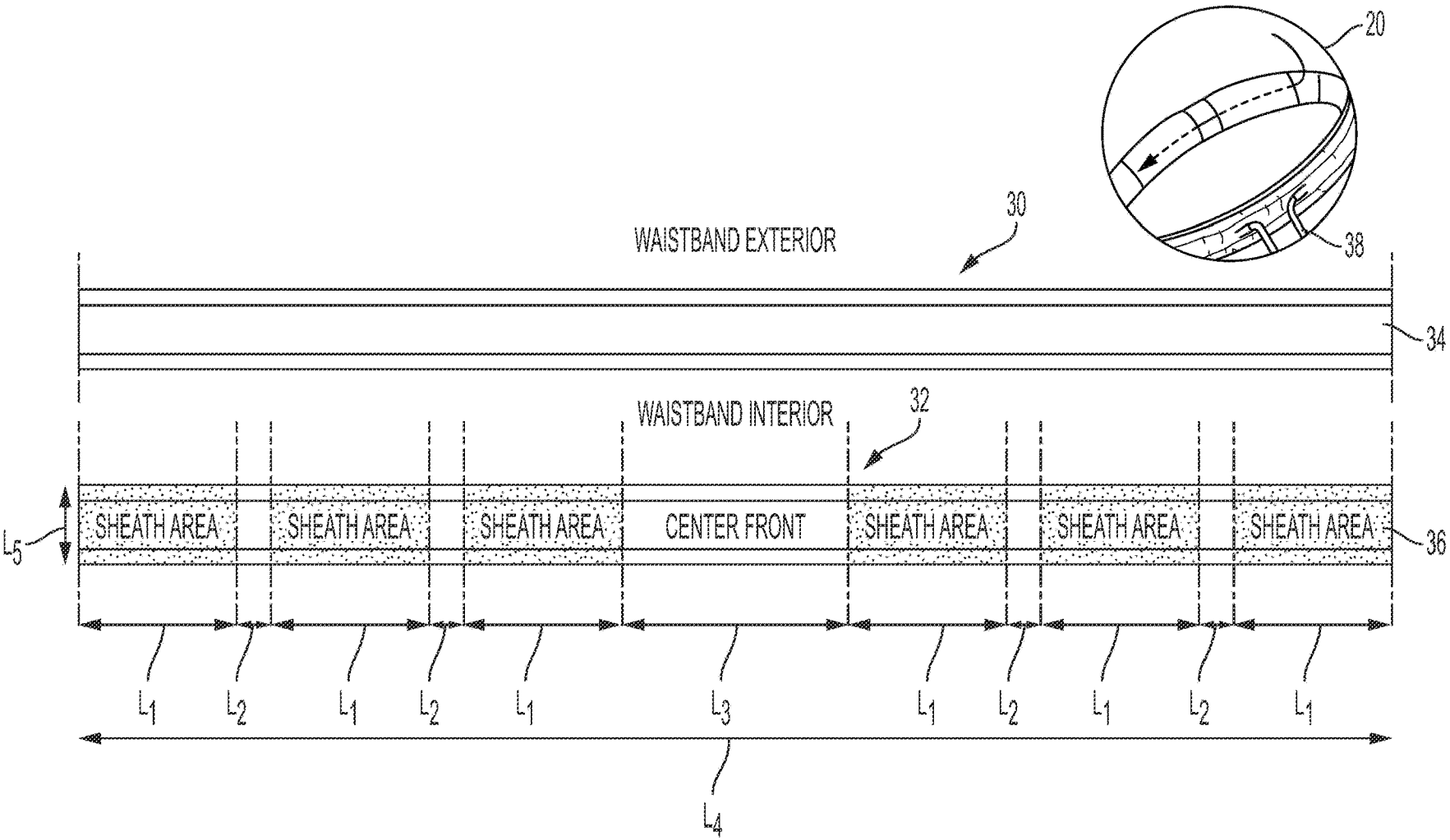
FIG. 3 illustrates an embodiment of a waistband design, according to an exemplary aspect of the present disclosure.

Referring to FIG. 3, waistband 20 of the present disclosure may be configured to combine an elastic band, drawstrings, and a removable, semi-rigid belt with a front closing mechanism. From the perspective of a wearer, waistband portion 20 may include an exterior portion 30 and an interior portion 32. In one embodiment, exterior portion 30 may be a non-removable portion forming a circumferential waist part of the joggers 22. Exterior portion 30 may include multiple layers of fabric sewn together to provide at least two tunnels or channels. For example, an inner channel of exterior portion 30 may include at least one stretchy elastic band 34. Exemplary elastically stretchable materials may include stretch knit, Lycra®, elastane, Spandex, Spandex blends and the like. Elastic band 34 may be designed to have a horizontal stretch to accommodate different waist sizes of wearers, but limited vertical stretch. That is, elastic band 34 may be designed to have a horizontal stretch factor greater than its vertical stretch factor. Here, stretch factor refers to how far a fabric stretches past its relaxed state. An outer channel of exterior portion 30 may include drawstrings 38 as shown in FIG. 1A. A pair of apertures 40 may be formed on exterior portion 30 to allow drawstrings 38 to exit the outer channel on two sides. In a preferred embodiment, drawstrings 38 may be threaded into exterior portion 30 within the outer channel, and there is stitching through the elastic band 34 that holds drawstrings 38 in the middle of the elastic band 34 of waistband 20.

Interior portion 32 of waistband 20 may be implemented on an internal circumference of waistband 20 (i.e., facing toward the wearer's body), immediately adjacent exterior portion 30. In accordance with aspects of the present disclosure, interior portion 32 may use a "broken sheath" design that inverts the typical spatial ratio between skinny belt loops spaced far apart, such that a semi-rigid belt may be affixed to the inside of waistband 20 for securing and carrying an object on a wearer's waist. As shown in FIG. 3, a plurality of belt loops or sheaths of cloth 36 of length $L_1$ with spacing $L_2$ between adjacent belt loops may be positioned along the circumferential interior portion of waistband 20 to allow a wearer to insert or remove the semi-rigid belt through these cloth loops 36. In one embodiment, the width $L_5$ of waistband 20 may be approximately 2" and the belt loops 36 may be designed to accommodate a belt having a width ranging from 0.75" to 1.75". In a preferred embodiment, a belt to be used with waistband 20 may have a width of 1.5". In order to provide greater uniform retention to the belt therethrough, the belt loops 36 may have extended dimensions in comparison with regular, narrow belt loops to increase the material's hold or position on the belt when the belt is inserted. As a result, belt loops 36 of the present disclosure increases support for waist-mounted accessories and provides a consistently firm foundation everywhere on the waistband. In one embodiment, each belt loop 36 may be 3" long, and they may be spaced evenly along the circumferential interior portion of waistband 20 with the exception of a larger gap between belt loops 36 at the front of joggers 22 to accommodate a belt buckle (e.g., center front with a length $L_3$ in FIG. 3). The belt loops 36 may be spaced apart (e.g., spacing $L_2$ between adjacent belt loops) to allow the wearer to more easily feed the belt through them when installing or removing, and the even spacing throughout waistband 20 further contributes to a uniform level of support for an object fastened anywhere around the 360° of the wearer's waist. The measurement of spacing between the loops may vary by waist size. For example, a large waist size may require more space between two adjacent loops 36. In a preferred embodiment, the ratio and placement of the spacing between two adjacent belt loops 36 may stay consistent for waistband 20 in different sizes with belt loops positioned approximately at the wearer's 1 o'clock, 3 o'clock, 5 o'clock, 7 o'clock, 9 o'clock, and 11 o'clock, with equal spacing between all belt loops other than the spacing between the 1 o'clock and 11 o'clock loops, which may be between three and seven times, more preferably between two and five times, yet more preferably between two and four times, even more preferably between two and three times, as much distance compared with the distance between any of the other belt loops in the waistband interior. The number and length of belt loops may change in a different embodiment of the waistband 20, including cases where belt loops may not all be of the same length.

Figure 4:
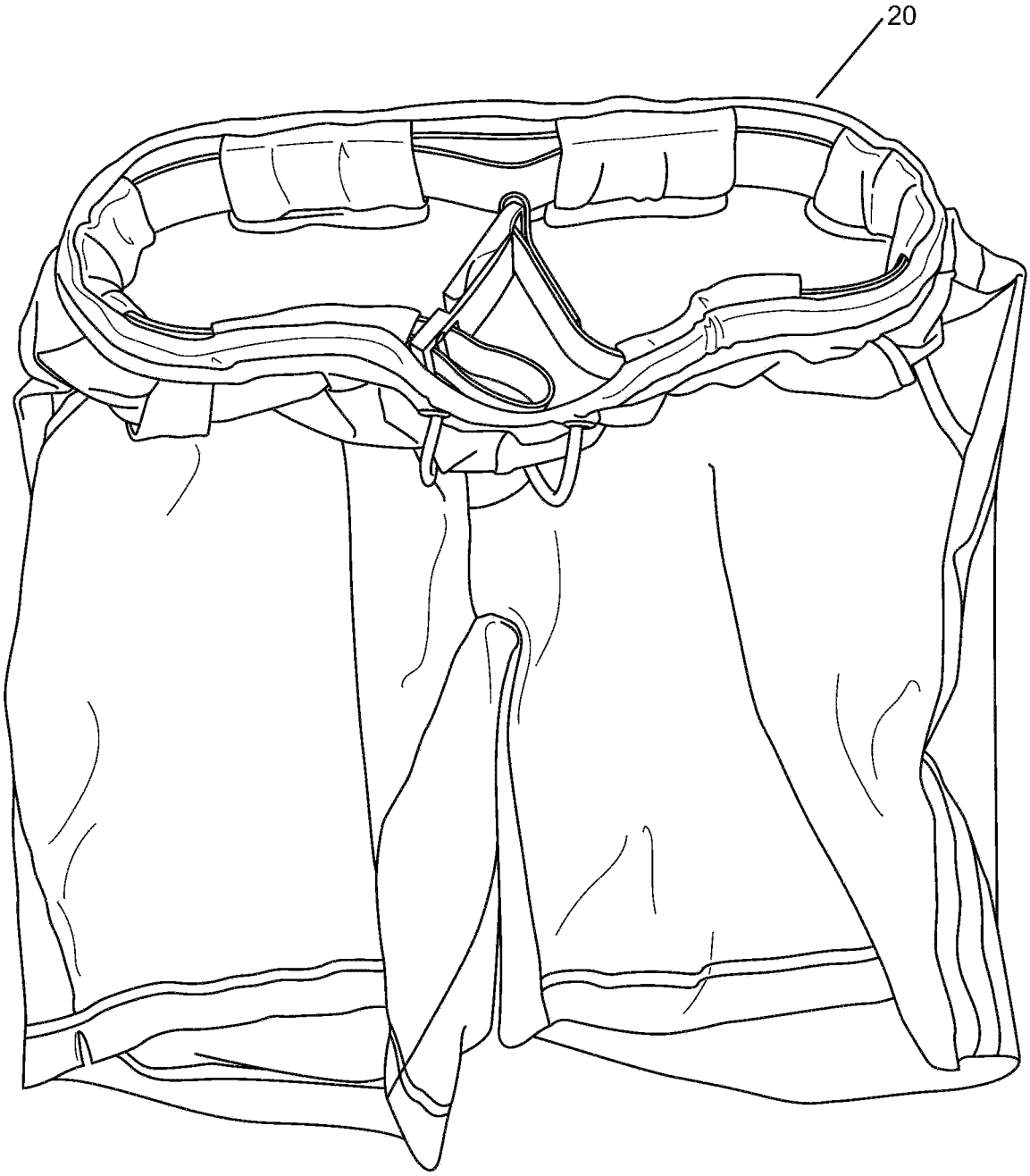
FIG. 4 illustrates an example pair of athletic shorts designed to provide a concealed carry of an object (e.g., a handgun secured in a holster) around a waist of a wearer having an active lifestyle, according to an exemplary aspect of the present disclosure.
Figure 5:
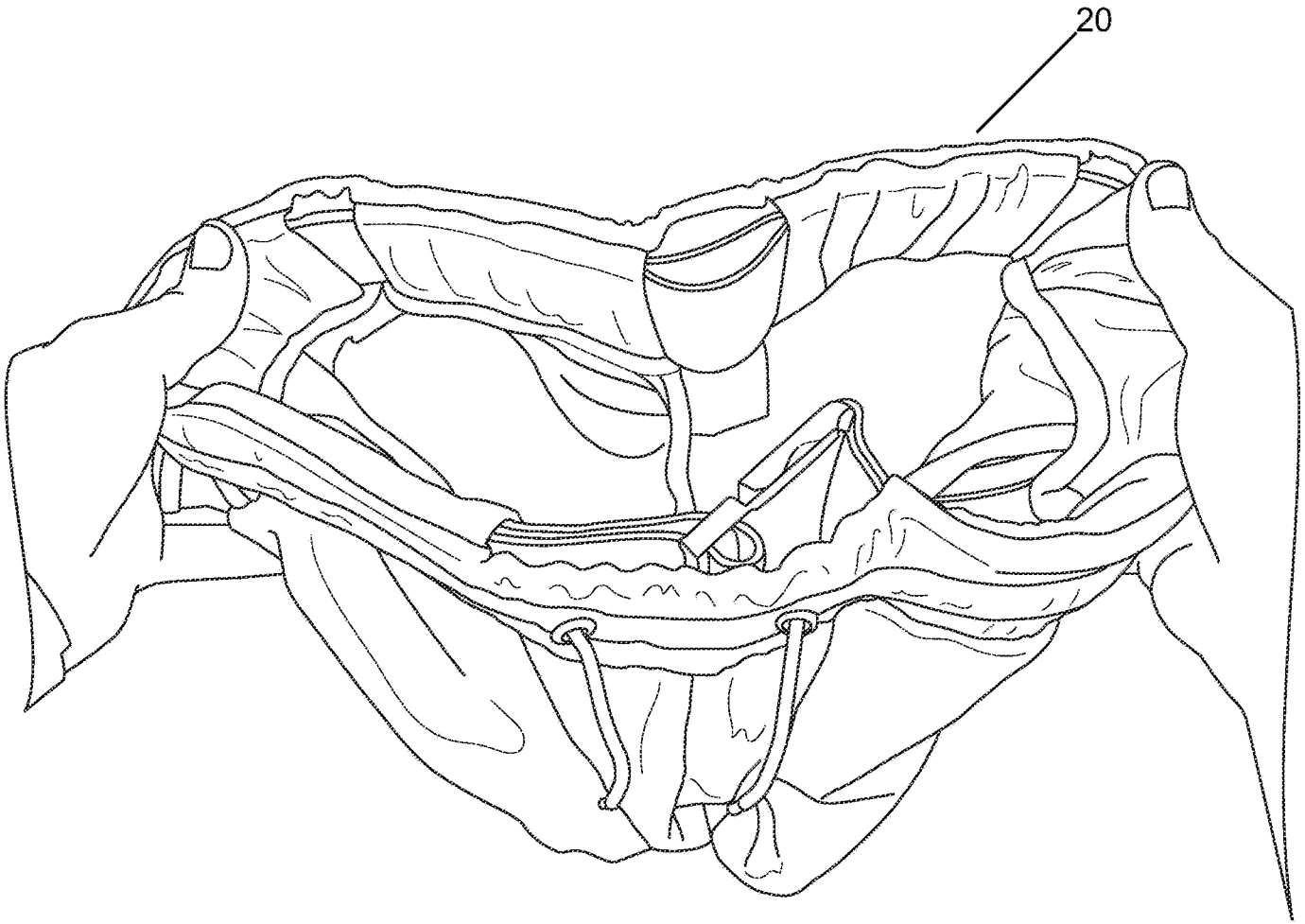
FIG. 5 illustrates a close view of a waistband portion of an example pair of jogger pants designed to provide a concealed carry of an object (e.g., a handgun secured in a holster) around a waist of a wearer having an active lifestyle, according to an exemplary aspect of the present disclosure.
Figure 6A:
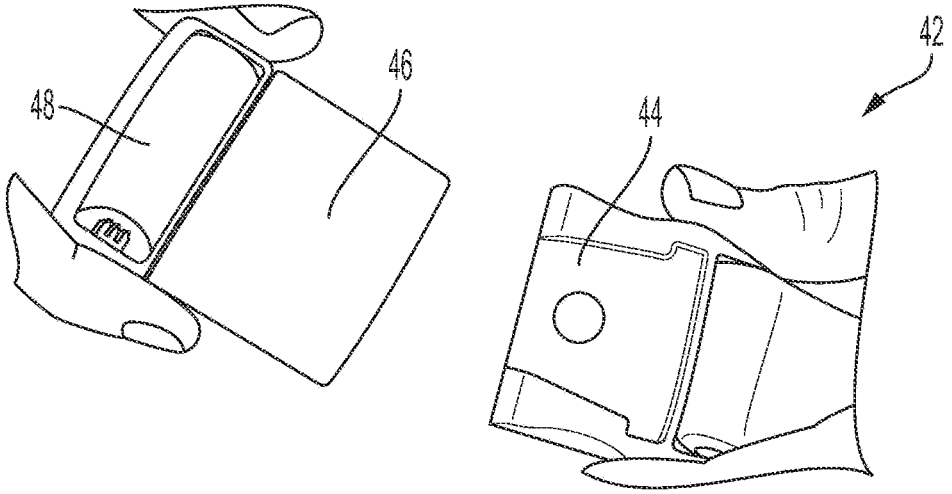
FIGS. 6(A)-(F) illustrate a first belt assembly, according to an exemplary aspect of the present disclosure.
Figure 6B:
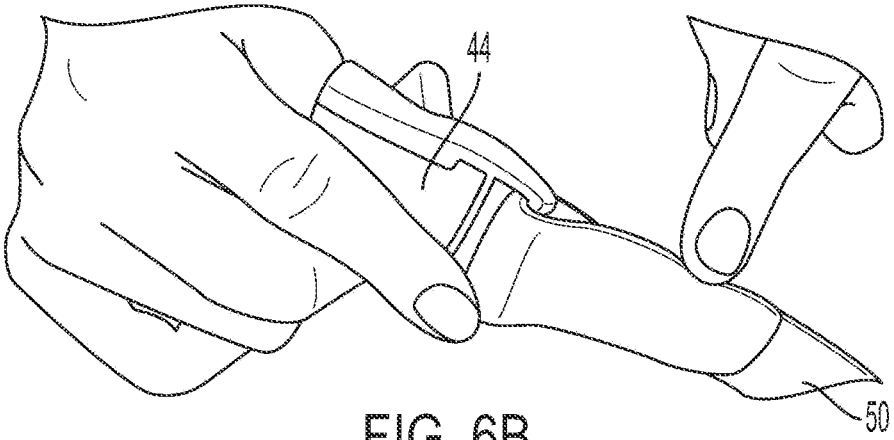
Figure 6C:
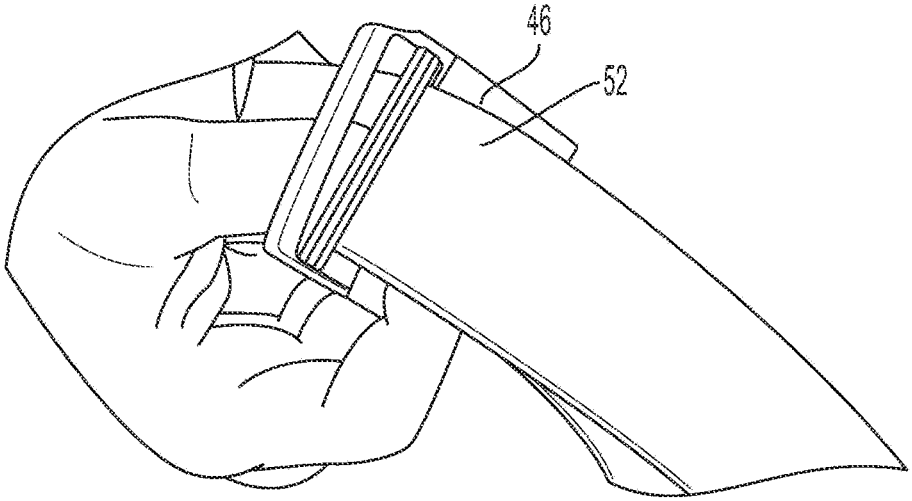
Figure 6D:
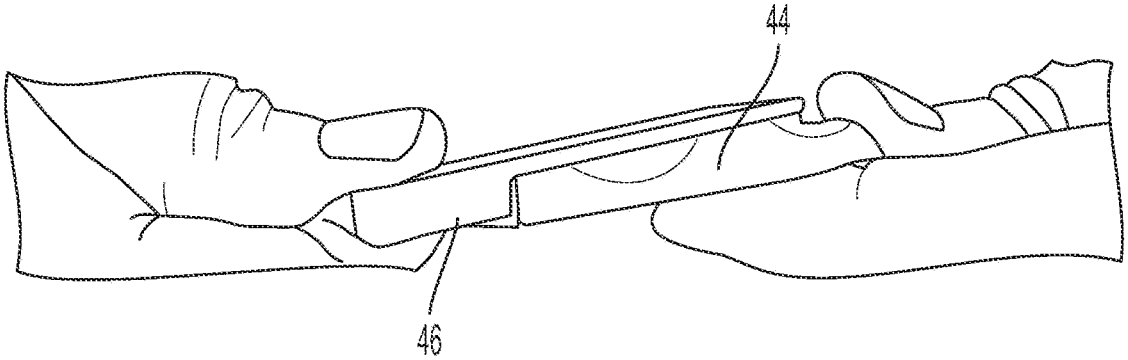

Referring to FIGS. 6(A)-6(F), in accordance with aspects of the present disclosure, an example semi-rigid belt assembly 42 may be clasped at the front of a waist portion of tactical apparel as shown in FIGS. 4 and 5 to allow for easy fastening and unfastening while retaining a predetermined amount of tension when fastened, such that a wearer does not have to readjust the fastened fitment of waistband 20 each time they put on or take off the apparel. As shown in FIG. 6(A), semi-rigid belt assembly 42 generally includes a buckle formed by first and second fastening members 44 and 46 when combined together and a suitable strap 48, belt, rope, etc. Both fastening members 44 and 46 of the belt assembly 42 may have the same thickness and when clasped together as shown in FIG. 6(D) provide an in-line buckle. In one embodiment, semi-rigid strap 48 may be made of elasticized nylon or any suitable stretchy material and have a horizontal stretch and vertical rigidity (e.g., vertical stretch factor is zero or close to zero).

Fastening members 44 and 46 of the buckle may be made of metal, plastic, hard rubber or dense polymer according to their intended use and the buckle may be attached to strap 48 in any suitable way. For example, as shown in FIGS. 6(A) and 6(B), fastening member 44 and one distal end 50 of strap 48 may be fixedly attached with each other via a slot provided in member 44 for passing or looping the distal end 50 therethrough and then sewing or affixing the distal end 50 onto strap 48. Similarly, a slot may be provided on fastening member 46 for passing the other distal end 52 of strap 48. In one embodiment, one of fastening members 44 and 46 and strap 48 may be releasably attached to each other, such that a corresponding distal ends 50 and 52 of strap 48 may be completely removed from fastening members 44 or 46. In an alternative embodiment, both distal ends 50 and 52 may be removable from fastening members 44 and 46 to facilitate installing and removing strap 48 via belt loops 36.

Figure 6E:
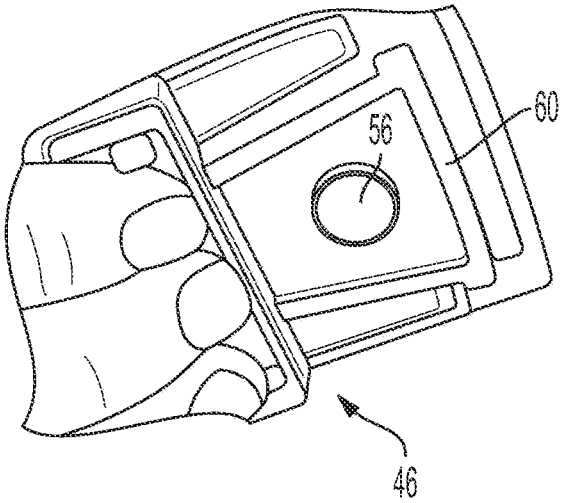
Figure 6F:
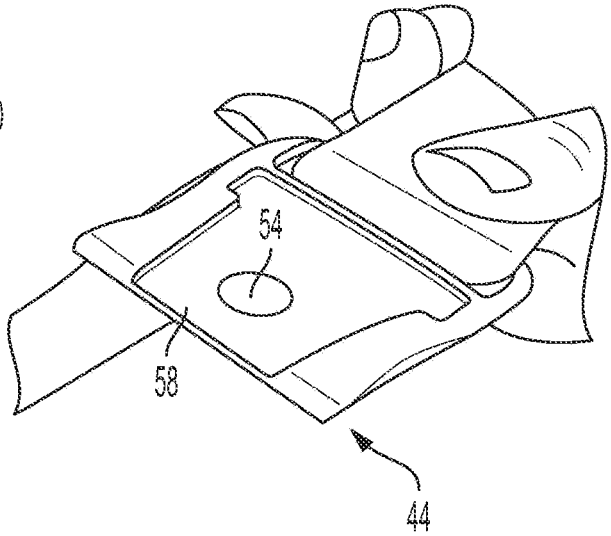

The in-line buckle formed by fastening members 44 and 46 may be narrow, slim, light weight and have a rapid clasp design. In one preferred embodiment, the buckle may be configured to implement magnetic retention means to couple and decouple fastening members 44 and 46. For example, as shown in FIGS. 6(E) and 6(F), magnets 54 and 56 may be respectively placed on a main body of fastening members 44 and 46. In order not to cancel the magnetic effects of the magnets 54 and 56 for their intended purposes, fastening members 44 and 46 may be made of non-conducive materials. Fastening member 44 may include a cutout portion 58 having a configuration and shape complementary to a raised portion 60 of fastening member 46. When fastening members 44 and 46 are coupled together by a wearer, portions 58 and 60 are brought into a close abutting relationship, and portion 60 will fit into the cutout portion 58. That is, portions 58 and 60 may be pressed together to seat portion 60 in the cavity or cutout portion 58. To prevent the possibility of portions 58 and 60 from disengaging from each other, a pair of permanent magnets 54 and 56 that have opposite poles may be used. For example, a North or South pole 56 may be placed in portion 60 and a South or North pole 54 may be placed in the cutout portion 58. Attractive magnetic force exerted by permanent magnets 54 and 56 retain the two fastening members 44 and 46 in a tight clasped relationship preventing any attempt to separate due to vibration or distorting of the buckle and/or dynamic weight load change along the circumference of the semi-rigid strap 48. In one embodiment, in the event the buckle is made of plastic, a friction coating may be provided in the cutout portion 58 and on the underside and edges of raised portion 60 to ensure a positive grip when fastening members 44 and 46 are pressed together. To unclasp, a wearer may slide fastening members 44 and 46 of the buckle toward each other to reduce the magnetic attractive force between permanent magnets 54 and 56 and to manually disengage portions 60 and 58 so that the wearer may pull fastening members 44 and 46 apart.

Figure 7A:
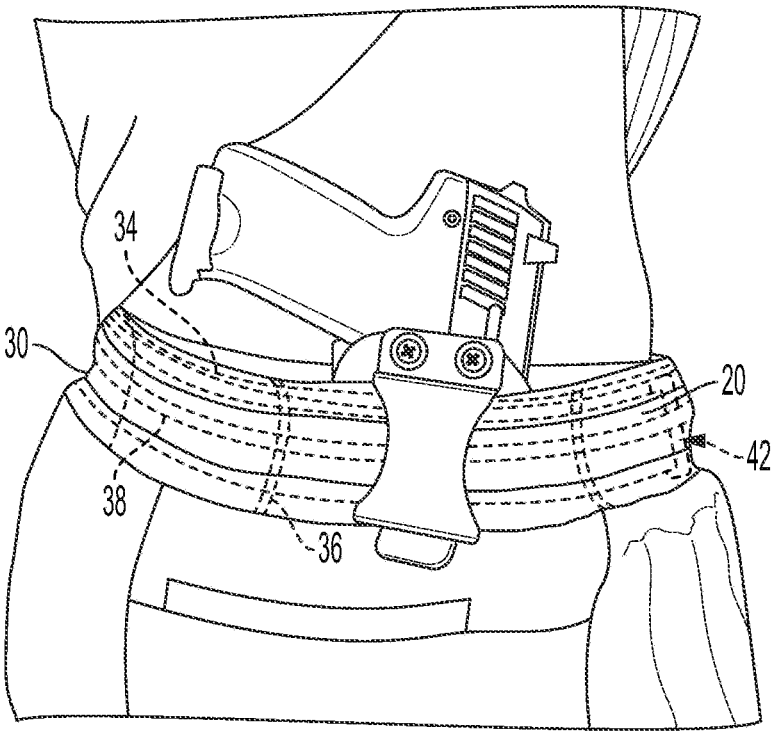
FIGS. 7(A)-7(C) illustrate users wearing tactical apparel including a waistband for carrying at least one bolstered handgun and other objects, according to an exemplary aspect of the present disclosure.
Figure 7B:
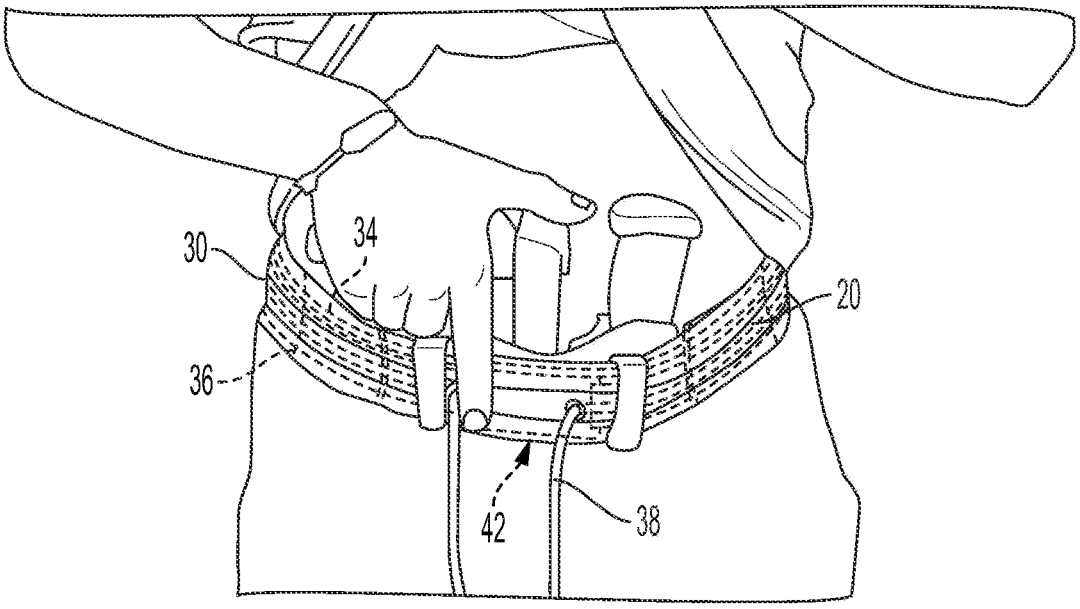
Figure 7C:
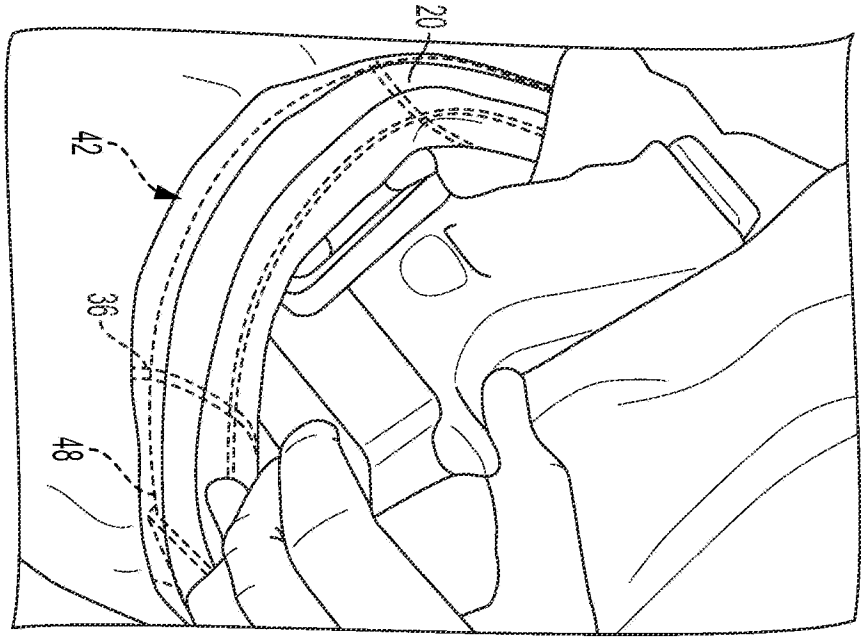

FIGS. 7(A)-7(C) illustrate users wearing tactical apparel including the disclosed waistband design for carrying at least one holstered handgun and other objects. Waistband 20 of the present disclosure may provide secure retention to handguns inside properly fitting holsters, and specifically "inside the waistband" holsters. These holsters may generally include one or multiple retention clips, which may be narrow or wide, for affixing the holsters onto other items, such as waistband 20 of the present disclosure.

To support the weight of a handgun in a holster without sagging or becoming unstable (i.e., bouncing) on a wearer's waist, and retain the holster against the wearer's body, waistband 20 of the present disclosure relies upon the combined tension provided by at least drawstrings 38, an elastic band 34, a semi-rigid belt assembly 42, and friction against the wearer's body. Positioning the semi-rigid belt assembly 42 along the interior side of waistband 20 may provide increased retention and stability to the handgun in the holster, such that a wearer may carry concealed firearms when wearing athletic clothing which traditionally does not include a built-in holster mechanism nor sufficient support for a detachable holster. Specifically, elastic band 34 of waistband 20 may have a first horizontal stretch factor selected to accommodate a range of waist sizes of wearers. Semi-rigid belt assembly 42 may have a second horizontal stretch factor selected to increase support for waist-mounted accessories through tension against the wearer's body and to provide a consistently firm foundation on waistband 20 while maintaining a limited degree of horizontal stretch to ensure comfort for the wearer during strenuous activity. In some embodiments, the second horizontal stretch factor of the semi-rigid belt assembly may be less than the first horizontal stretch factor of the elastic band sewn into waistband 20. Drawstrings 38 may be configured to provide a relatively snug and/or secure fit of waistband 20 on a wearer's body. That is, drawstrings 38 may have a horizontal stretch factor less than that of either elastic band 34 or belt assembly 42.

As shown in FIGS. 7(A) and 7(B), a wearer may slide a holster clip or multiple clips on the upper edge of exterior portion 30 of waistband 20 at a selected position (e.g., 3 o'clock position, 4 o'clock position, kidney carry, appendix carry or back carry), such that the holster and the handgun stored therein may fit in between the semi-rigid belt assembly 42 when affixed inside the belt loops and the wearer's body. The plurality of wide belt loops 36 on the interior side of waistband 20 minimize skin contact areas between the belt assembly 42 and the wearer's waist, thereby improving the comfort and wearability of waistband 20. In this embodiment, waistband 20 allows the wearer to place the holster anywhere around waistband 20 in 360 degrees except for where the buckle is located. Further, the holster may be easier to remove by the wearer from waistband 20 when the holster clip or clips go around the whole waistband 20.

Referring to FIG. 7(C), a wearer may slide a holster clip on the upper edge of strap 48 of semi-rigid belt assembly 42 in a spacing area between two adjacent belt loops 36. In so doing, the holster clip may be completely hidden within waistband 20 and the holster and the handgun stored therein fit in between the semi-rigid belt assembly 42 and the wearer's waist.

In an alternative embodiment, waistband 20 may include similar combination of an elastic band 34, drawstrings 38, and a removable semi-rigid belt assembly 42, but the "broken sheath" design as shown in FIG. 3 is on the outside of waistband 20. As such, the removable semi-rigid belt assembly 42 may work with OWB accessories and holsters. A design such as this may allow a variety of applications for contractors carrying tools (e.g., hammers or drills in saddles) at the waist, or for cell phone pouches, walkie talkies, radios, or other technology built to clip onto a belt.

Figure 11:
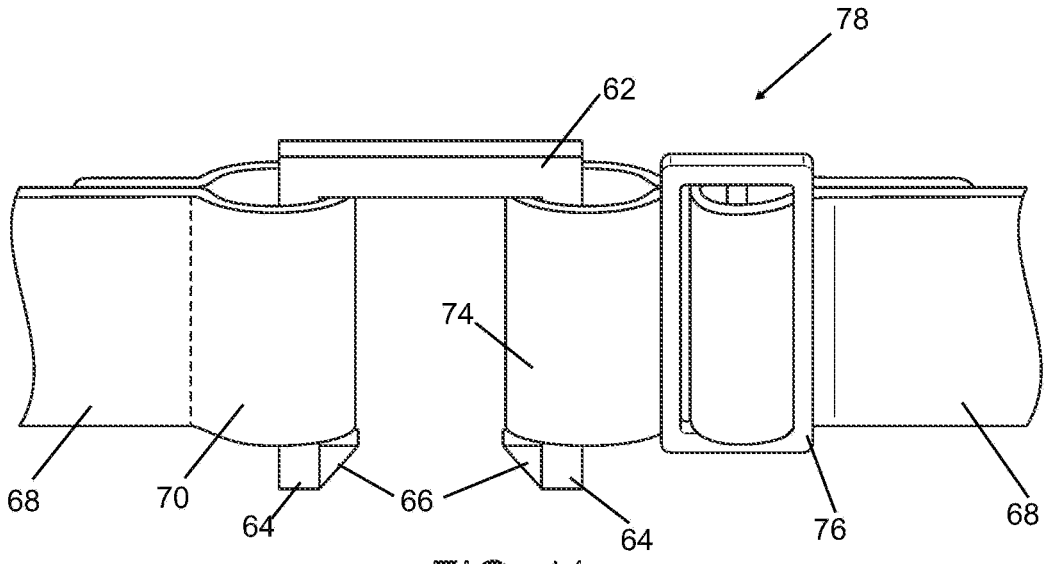
FIG. 11 illustrates a view of a second belt assembly, according to an exemplary aspect of the present disclosure.
Figure 12:
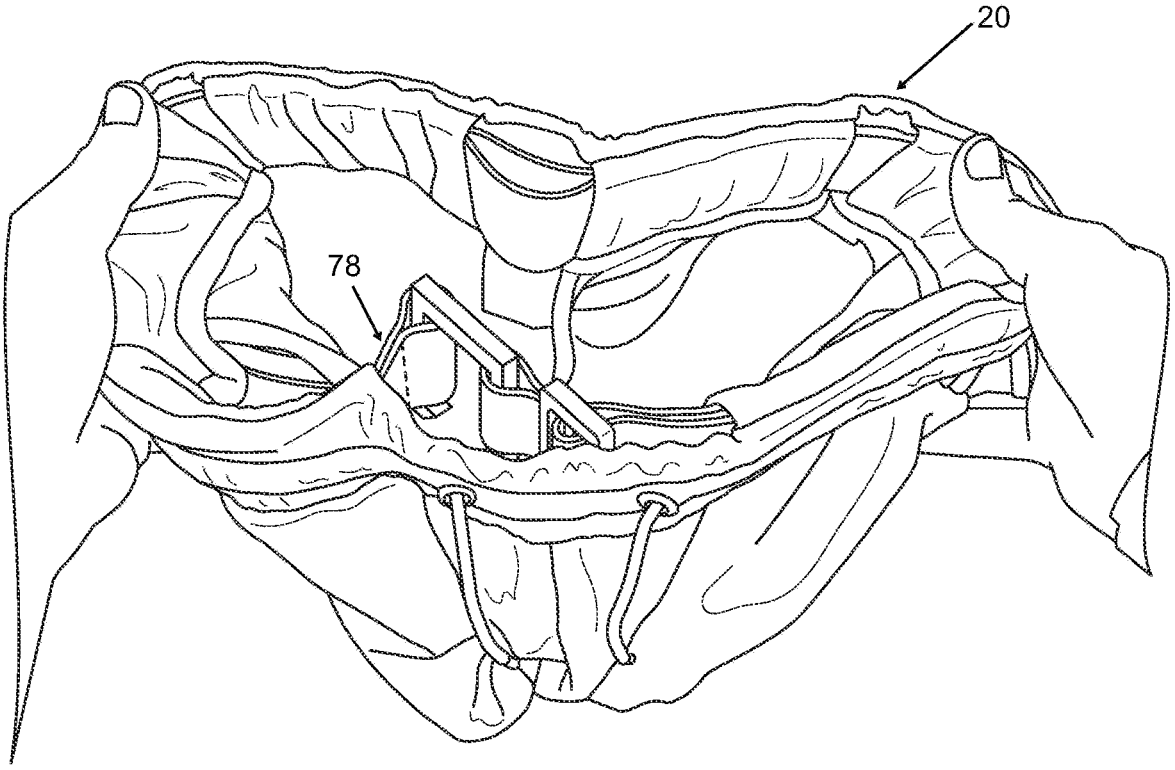
FIG. 12 illustrates a close view of a waistband portion of pants having a second belt assembly, according to an exemplary aspect of the present disclosure.

In accordance with further aspects of the present disclosure, an example belt assembly (FIG. 11) may be configured to allow a wearer to quickly set up and retain the wearer's dimensions between wears by, e.g., only removing a detachable buckle (FIG. 8) and keeping a tension lock (FIG. 10) adjusted without losing a belt (FIG. 9) of the belt assembly into pants that include the aforementioned waistband design 20 for carrying at least one holstered handgun and other objects (FIG. 12).

Figure 8:
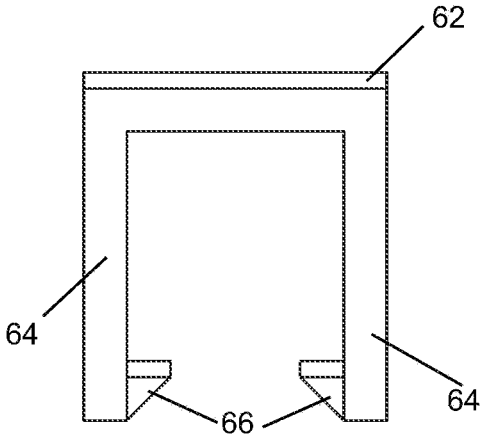
FIG. 8 illustrates a detachable buckle of a second belt assembly, according to an exemplary aspect of the present disclosure.

As shown in FIGS. 8 and 11, a fully detachable buckle 62 (e.g., made of metal or any suitable material) may be formed in, e.g., a rectangular shape with one of the sides (bottom horizontal crossbar) left open. In one embodiment, the length of each vertical leg 64 of the detachable buckle 62 may be longer than the length of each horizontal crossbar. At the base of each leg 64 of the detachable buckle 62, on the side left open, two small obstructions 66 may be implemented on the inside of each vertical leg 64. In one embodiment, the top of each obstruction 66 may be formed at a right angle to a corresponding buckle leg 64, and the bottom of each obstruction 66 may be formed at a 45 degree angle to the corresponding buckle leg 64, thereby forming two right triangles out of obstructions 66 that point toward each other but do not touch, such that the bottom side of the detachable buckle 62 remains open. In one embodiment, the length of each vertical leg 64 of the detachable buckle 62 extending below the top horizontal crossbar may be at least equal to the height of belt 68 of FIG. 9 plus the length of a non-hypotenuse leg of each obstruction 66 that is co-planar with the inside of each vertical leg 64. In one preferred embodiment, the width to the outside edges of the top horizontal crossbar may range from 1" to 3", where each of the two parallel vertical legs 64 of the detachable buckle 62 may be approximately ¼" to ½" in diameter if the cross section profile of each vertical leg is cylindrical in shape. It should be appreciated that the vertical legs 64 may be configured to have any suitable dimension and/or shape (e.g., square).

Among other features, the detachable buckle 62 of the present disclosure may be fully removable without losing the slack and has no metal-on-metal connection that may cause noise during use. The detachable buckle 62 may be both thin (front to back) and narrow (side to side) to reduce the obstacle to a wearer when positioning a holstered firearm in a waist-mounted carry position at the wearer's front. The design of the detachable buckle 62 may not contain any moving parts, thereby make the overall belt assembly 78 of FIG. 11 more reliable and durable.

Further, the detachable buckle 62 may be inserted or removed quickly with deliberate movements by a wearer, as, by being open on the bottom horizontal side, the wearer does not have to fumble around inside his pants below the waistline to insert or remove the detachable buckle 62. It should be appreciated that, each obstruction 66 at the bottom of the detachable buckle 62 may be shaped or dimensioned to have any suitable shape and configuration so as to ensure that the detachable buckle 62 does not slip off the belt 68 during movement or jostling when certain amount of tension is exerted on the belt 68 around the wearer's waist.

Figure 9:
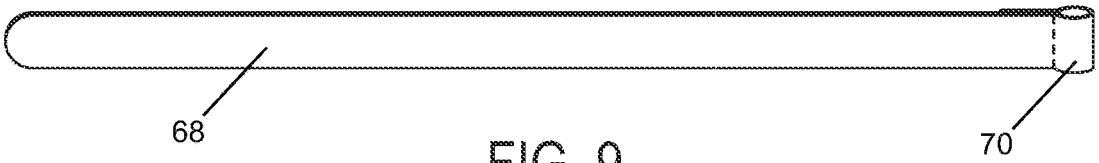
FIG. 9 illustrates a belt portion of a second belt assembly, according to an exemplary aspect of the present disclosure.
Figure 10:
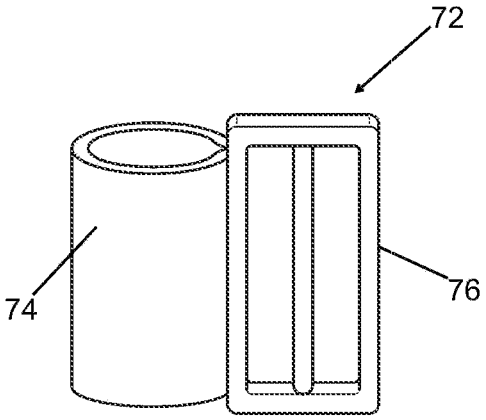
FIG. 10 illustrates a tension lock of a second belt assembly, according to an exemplary aspect of the present disclosure.

Referring to FIG. 9, belt 68 may be manufactured with the same material properties of the semi-rigid belt assembly 42 of FIGS. 6(A)-6(F) regarding rigidity and flexibility. In one embodiment, one distal end of belt 68 may terminate in a connecting portion. e.g., a sewn cylindrical loop 70 oriented vertically with the belt 68, such that the openings of loop 70 are on the top and bottom of the belt 68 when worn on a standing person's waist. The opposite end from the sewn loop 70 terminates in belt material. As shown in FIG. 10, a tension lock 72, manufactured from e.g., metal or any suitable material, may be designed for a non-loop end of the belt 68 to feed through slots of a slide buckle 76 and double back, creating tension and enabling the length of the belt 68 to be adjusted. A second connecting portion (e.g., a cylindrical loop 74) may be affixed to one end of tension lock 72, oriented vertically. In one embodiment, the connecting portion 70 of belt 68 and tension lock 72 may be configured to ensure that belt 68 does not retreat into the waistband 20 of pants if the detachable buckle 62 is removed, thereby maintaining a wearer's preferred dimensions and adjustment while allowing the belt 68 to be easily re-buckled when needed.

As shown in FIGS. 8-11, the detachable buckle 62 of belt assembly 78 may be configured to be dimensionally small, made of only one piece of metal, and reliant on both tension and obstructions where it contacts the cylindrical loops 70 and 74 to hold it in place. Buckle design 62 is light, thin, narrow, quiet and less prone to malfunction.

Belt assembly 78 of the present disclosure also includes multiple connecting portions (e.g., the cylindrical loops 70 and 74 and the tension lock 72) configured to allow the detachable buckle 62 to fasten the belt 68. These connecting portions may be configured to provide adjustability to fit various waist sizes, while preventing the ends of the belt 68 from being lost into the waistband 20 if the detachable buckle 62 has been removed. In one embodiment, in order to prevent the belt 68 from retreating into the waistband 20, the height of the detachable buckle 62 and each connecting portion may be configured to be slightly greater than the width of the belt 68 and the belt loops. For example, each connecting portion may be about 1.75" tall when the width of the belt and each belt loop is about 1.5". Accordingly, the detachable buckle 62 may be approximately 2" in total height, where the space between the bottom of the top crossbar and the top of the obstruction may be 1.75" or so.

Further, belt 68 and its material of construction may provide the support and flexibility needed to carry concealed. In accordance with aspects of the present disclosure, belt 68 may be designed to have a horizontal stretch or elasticity to accommodate different waist sizes of wearers, but a limited vertical stretch. That is, belt 68 may be designed to have a horizontal stretch factor greater than its vertical stretch factor. This horizontal elasticity is crucial for the detachable buckle design 62 to keep tension on both sides of the detachable buckle 62 and to accommodate the wearer's holstered sidearm in comfort and security.

Referring to FIG. 12, to incorporate the belt assembly 78 into waistband 20 of a pair of pants, a wearer may thread the open ("non-loop") end of the belt 68 through a plurality of belt loops (e.g., belt loops 36 of FIG. 3) of the waistband 20 until the loop end of the belt was flush with the first of the belt loops at the front of the pants and the open end was hanging loose, having threaded through every belt loop and returned to the front of the pants.

Subsequently, the wearer may feed the open end of the belt 68 into the tension lock 72 and use the clasp mechanism disclosed above to adjust the placement of the tension lock 72 along the length of the belt 68, returning any excess slack from the open end of the belt back into the belt loops in the opposite direction from the main belt 68.

In accordance with aspects of the present disclosure, the right triangle construction of the obstructions 66 on the detachable buckle 62 may be dimensioned and designed for the detachable buckle 62 to easily slide into place in the cylindrical loops 70 and 74 even when the belt 68 is under substantial tension around the wearer, enabling the cylindrical loops 70 and 74 to follow a "track" down the slope of the obstructions before snapping into place after clearing the obstruction. Once in place, the cylindrical loops 70 and 74 may be retained in place by the right angle of each obstruction 66. With the cylindrical loops 70 and 74 positioned according to the waist measurements of the wearer, the wearer may insert legs 64 of the detachable buckle 62 into respective loops 70 and 74 to tether both open ends of the belt and form a continuous connection around the wearer. If the belt 68 is too tight or too loose, the wearer may adjust the placement of slide buckle 76 along the belt 68 to tighten or loosen the belt around the waist, the connector loops will need to be of a dimension that is large enough to fit around the leg of the detachable buckle but small enough to provide a secure connection. In one embodiment, the internal dimension of each of cylindrical loops 70 and 74 may range from ⅓" to ⅔" to ensure a secure attachment with each vertical leg 64 of the detachable buckle 62, but also enough slack to enable the wearer to remove the buckle from each loop 70 and 74 with deliberate motion.

The above description of the disclosure is provided to enable a person skilled in the art to make or use the disclosure. Various modifications to the disclosure will be readily apparent to those skilled in the art, and the common principles defined herein may be applied to other variations without departing from the spirit or scope of the disclosure. Further, the above description in connection with the drawings describes examples and does not represent the only examples that may be implemented or that are within the scope of the claims.

Furthermore, although elements of the described aspects and/or embodiments may be described or claimed in the singular, the plural is contemplated unless limitation to the singular is explicitly stated. Additionally, all or a portion of any aspect and/or embodiment may be utilized with all or a portion of any other aspect and/or embodiment, unless stated otherwise. Thus, the disclosure is not to be limited to the examples and designs described herein but is to be accorded the widest scope consistent with the principles and novel features disclosed herein.

The invention claimed is:

1. An article of clothing, comprising:

a waistband configured to secure and carry at least one object on a wearer's waist, the waistband comprising:

a first portion configured to form a circumferential waist part of the article of clothing and include at least a first channel and a second channel, the first channel having an elastic band therethrough, and the second channel having drawstrings therethrough; and a second portion configured to include a plurality of belt loops evenly spaced and positioned along the first portion of the waistband, wherein the plurality of belt loops are configured to receive a belt assembly therethrough.

2. The article of clothing of claim 1, wherein the at least one object includes a holster with a handgun stored therein, wherein the holster comprises at least one releasable holster clip for releasably securing the holster to the waistband.

3. The article of clothing of claim 1, wherein the belt assembly has a horizontal stretch and a vertical rigidity.

4. The article of clothing of claim 1, wherein the elastic band is configured to have a first horizontal stretch factor selected to accommodate a range of waist sizes of wearers.

5. The article of clothing of claim 4, wherein the belt assembly is configured to have a second horizontal stretch factor selected to provide a support for waist-mounted accessories and a consistently firm foundation on the waistband, wherein the second horizontal stretch factor is less than the first horizontal stretch factor.

6. The article of clothing of claim 5, wherein the drawstrings are configured to have a third horizontal stretch factor selected to provide a snug and secure fit of the waistband on a wearer's body, wherein the third horizontal stretch factor is less than the second horizontal stretch factor.

7. The article of clothing of claim 1, wherein the belt assembly comprises two fastening members configured to form an in-line buckle at the front of the waistband via a pair of permanent magnets.

8. The article of clothing of claim 7, wherein the belt assembly comprises a strap configured to at least releasably attach to at least one of the two fastening members.

9. The article of clothing of claim 1, wherein the first portion of the waistband is configured to face an outside of the article of clothing.

10. The article of clothing of claim 1, wherein the second portion of the waistband is configured to face an outside of the article of clothing.

11. The article of clothing of claim 2, wherein the at least one releasable holster clip is affixed onto the first portion of the waistband.

12. The article of clothing of claim 2, wherein the at least one releasable holster clip is affixed onto the belt assembly of the waistband.

13. The article of clothing of claim 1, further comprising at least one pocket for storing one or more objects, wherein the waistband is configured to support a weight of the one or more objects via the elastic band, drawstrings and the belt assembly.

14. The article of clothing of claim 1, wherein the plurality of belt loops are configured to be placed approximately at a wearer's 1 o'clock, 3 o'clock, 5 o'clock, 7 o'clock, 9 o'clock, and 11 o'clock positions.

15. The article of clothing of claim 14, wherein a first spacing between two adjacent belt loops at the wearer's 1 o'clock and 11 o'clock positions is greater than a second spacing between two adjacent belt loops in other positions, wherein the first spacing is approximately 2-5 times greater than the second spacing.

16. The article of clothing of claim 1, wherein the plurality of belt loops are of uniform sizes.

17. The article of clothing of claim 1, wherein the plurality of belt loops are of different sizes.

18. The article of clothing of claim 1, wherein the belt assembly comprises a detachable buckle, a belt and a tension lock.

19. The article of clothing of claim 18, wherein the detachable buckle includes two vertical legs, wherein an obstruction is implemented on a base of each vertical leg to retain the belt around the wearer's waist via a respective cylindrical loop at two distal ends of the belt.

20. The article of clothing of claim 18, wherein the belt is configured to have a horizontal stretch factor greater than its vertical stretch factor.

* * * * *